US005522696A

United States Patent [19]

Stansfield

[11] Patent Number: 5,522,696

[45] Date of Patent: Jun. 4, 1996

[54] MULTIPLE-SHUTTER THROTTLE CHARACTERIZATION ASSEMBLY FOR BURNERS

[75] Inventor: Tod A. Stansfield, Elm Grove, Wis.

[73] Assignee: Aqua-Chem, Inc., Milwaukee, Wis.

[21] Appl. No.: 368,480

[22] Filed: Jan. 4, 1995

[51] Int. Cl.[6] ..... F04D 29/46; F23M 9/02

[52] U.S. Cl. ..... 415/151; 415/155; 431/188

[58] Field of Search ..... 415/147, 150, 415/151, 155; 431/12, 188, 62; 454/139, 338

[56] References Cited

U.S. PATENT DOCUMENTS

| | | | |
|---|---|---|---|
| 2,201,437 | 5/1940 | Kice, Jr. | 415/155 |
| 2,458,541 | 1/1949 | Urquhart | 431/188 |
| 2,665,840 | 1/1954 | Powell | 415/151 |
| 4,197,076 | 4/1980 | Viger | 431/284 |
| 4,375,952 | 3/1983 | Vosper et al. | 431/171 |

FOREIGN PATENT DOCUMENTS

| | | | |
|---|---|---|---|
| 2633480 | 2/1978 | Germany | 415/151 |

*Primary Examiner*—Edward K. Look

*Assistant Examiner*—James A. Larson

*Attorney, Agent, or Firm*—Whyte Hirschboeck Dudek

[57] ABSTRACT

The present invention provides an air box throttle assembly for improved characterization of a combustion system in which an arrangement of three air shutters is used to maintain a fairly constant air to fuel ratio as the combustion system is driven from low fire to high fire. A high fire shutter and a main air shutter each comprise two vanes and are rotatably mounted within an air intake box for a combustion system. A low fire shutter is provided with a single vane and is fixed above the main air shutter. The high fire shutter is the principal regulator of large volumes of air entering the combustion system when operating at high fire. At high fire, the main air shutter is fully open and low fire shutter has little effect on the flow of air through the air intake box. Low fire shutter is the principal regulator of small volumes of air entering the combustion system when operating at low fire. At low fire, the main air shutter is substantially perpendicular to air flowing into the air intake box such that air flow is forced through a passageway defined between the low fire shutter and the main air shutter. When the combustion system is operating in the range between low fire and high fire, the high fire shutter is substantially open and the main air shutter is used to regulate the volume of air flowing into the combustion system.

9 Claims, 4 Drawing Sheets

MULTIPLE-SHUTTER THROTTLE CHARACTERIZATION ASSEMBLY FOR BURNERS

BACKGROUND OF THE INVENTION

1. Field of the Invention

The present invention relates to the field of fluid flow systems, and more particularly but not by way of limitation, to a method and apparatus for improving throttling characterization of industrial burners.

2. Discussion

In the control of fuel and air mixtures to industrial burners, furnaces, boilers and the like, there is a need to maintain proper proportions of the fuel and air over widely varying firing conditions from low fire to high fire. This requirement is driven by the desire to achieve maximum heat output while maintaining minimum fuel input. Although ideally these fuel and air mixtures comprise equivalent proportions of fuel and air at each firing rate, fuel can burn in a wide range of excess air levels. However, discrepancies between the ideal air amount and the actual air amount result in inefficient burn. For example, to much air will result in a flame that is cooled because the heat from the flame will be used to warm the excess air surrounding it. On the other hand, to little air will result in incomplete combustion which produces carbonization and high unburned fuel emissions. To assure complete combustion without over-cooling the flame, combustion is generally carried out with about 10% more air than theoretically required. The process in which this fuel to air ratio is held constant over varied firing rates is called characterization. Those skilled in the art will understand that maintaining the optimum ratio between fuel flow and air flow as the burner drives from a low firing rate to a high firing rate is difficult.

Conventional throttle mechanisms utilize throttle plates or shutters to regulate the amount of air which enters the burner. For example, U.S. Pat. No. 4,197,076 to Viger teaches use of a throttle plate of the butterfly valve type to control the air flow into the blower. An impeller is used to draw air into an air scoop and move the air through the burner system. The air scoop has an air intake opening with an adjustable shutter positioned across the opening. The shutter is adjusted to vary the amount of air entering the system.

U.S. Pat. No. 4,230,499 to Binasik, et al. teaches use of dual throttling plates across the entrance of an air intake chamber. The throttling plates are mounted on shafts which are interconnected by spur gears so that the shafts rotate in unison. A lever arm is fastened to one of the shafts. A connecting rod connects the lever arm with an output lever from an actuator to provide a throttle control for air entering the air chamber.

U.S. Pat. No. 4,375,952 to Vosper, et al. also teaches use of dual throttling shutters to regulate the amount of oxygen supplied to the flame in a variable rate burner. The air intake duct is provided with shutters such as a pair of vanes rotatably mounted on spaced shafts which are pivoted from the exterior of the duct via a mechanism so that more or less air can be admitted to the burner depending upon the load under which the burner operates at any given moment.

U.S. Pat. No. 4,595,355 to Garrelfs, et al. teaches an adaptation of the standard shutter system described above by implementing a rotary shutter. Draft control baffles are positioned over the air inlets of the burner. Air flow into the burner is regulated by rotating the baffles to adjust the size of the air inlet opening.

In the case of a butterfly valve throttle plate such as the ones described above, air flow is poorly characterized. Although these types of throttle systems are generally actuated by a mechanical motor which is attached to the shutters through linkage assemblies, they have limited adjustability to achieve adequate characterization. Before operation, the linkage assemblies are manually adjusted based on the stoichiometric requirements for a particular fuel input rate. During operation, in response to system demands, the motor can actuate the linkages and adjust the amount of air which moves past the shutters into the combustion chamber. Although there is sufficient air to allow optimum combustion at a single firing rate, the fuel to air ratio can not be optimally maintained from the low end to the high end of the firing rate range. Thus, these devices are optimized over a narrow firing rate range. If a different firing rate is desired, the linkages must be manually re-adjusted.

A number of prior art devices are known for varying inlet fuel valuing and inlet air venting in response to monitored signals, such as temperature and stoichiometric parameters, over a varying firing range. As pointed out in numerous prior art publications, and as is known by persons of ordinary skill in this field, each industrial burner application will have numerous variables which take each such installation beyond the range of prediction, and thus require that each such installation be provided with the capability of tailoring its characterizing controls to its peculiarities over the range of its firing usage. Several prior art characterizing, or proportioning controls are as follows.

U.S. Pat. No. 2,286,173 to Maxon teaches a valve to proportion air and fuel to industrial burner systems in which an air gate is journaled in an air passage bore and is rotatable by a segmental arm structure. A spring loaded stemmed valve (biased closed) is supported in a fuel inlet bore. A push rod is supported to engage the stemmed valve and is operable to open same as it is pressed against the stemmed valve. Actuating means are disposed to actuate the push rod by the arm structure which supports a series of individually adjustable threaded pins carried by the arm structure to variably depress the push rod along the arc of the arm structure to vary the air-fuel ratio. A flexible strip is disposed between the push rod and the threaded pins to facilitate engagement therewith.

U.S. Pat. No. 2,315,171 to Voorheis teaches an adjustable valve in which a series of adjusting screws provide a path to selectively depress a roller supported by an operating handle connected to a valve rod which is spring biased. The object of the invention is to move the valve control element through a predetermined sequence of valve settings.

U.S. Pat. No. 1,525,052 to Spotz teaches an adjustable cam surface and a cam follower. The shape of the cam surface is determined by a plurality of adjustable struts which connect it to a carrying frame.

U.S. Pat. No. 4,932,274 to Jones teaches a characterizing linkage assembly which comprises a cam comprising an adjustable curvalinear cam band which is rotatable by a drive shaft. A follower rod is urged against the cam band. An actuator arm attached to air intake shutters is attached to the follower rod. The curvalinear shape of the cam band can be varied by manipulating adjustment screws located along the surface of the curve. Rotation of the drive shaft in response to a change in firing rates imparts movement to the cam band, the follower rod, the linkage actuator arm and thus the intake shutters. In this way, the path of the follower rod can be altered, allowing the fuel to air combustion ratio to be held relatively constant as the burner is throttled between firing rates.

It would be desirable to provide a throttle assembly which could achieve optimum characterization between air and fuel as a burner is throttled between firing rates, but require very few moving parts. Such throttle assemblies would be less likely to succumb to mechanical problems and would be much less operator intensive.

SUMMARY OF THE INVENTION

The present invention provides an air box throttle assembly for improved characterization of a combustion system in which an air shutter arrangement is used to maintain a fairly constant air to fuel ratio as the combustion system is driven from low fire to high fire.

The present system comprises an air box containing a main air shutter used in conjunction with a low fire shutter and a high fire shutter. The main air shutter is a typical butter-fly throttle valve found in standard throttle systems, the shutter comprising a first vane and a second vane which rotate about a longitudinal axis. The second vane is narrower than the first vane. The main shutter is centrally located in the air box and positioned so that air entering the box must pass by the main shutter before entering the combustion system. Rotated to a fully open position, the vanes of the shutter are substantially parallel to the direction of air flow and thus present minimal resistance as air flows by the shutter. Rotated to a fully closed position, the vanes of the shutter are substantially perpendicular to the direction of air flow so that the edge of each vane is adjacent a wall of the air box. The clearance between the first vane and its adjacent wall allows unimpeded movement of the vane while allowing minimal air flow between the vane and the wall. However, the edge of the second vane and its adjacent wall define a larger gap through which air can freely flow. The flow of air, therefore, is forced along the path of least resistance which is between the air box and the second vane. When the combustion system is operating at low fire, the main shutter is fully closed because the combustion system requires a smaller quantity of oxygen to maintain the proper air to fuel ratio. Conversely, when the combustion system is operating at high fire, the main air shutter is fully open because the combustion system requires larger quantities of air to maintain the proper fuel to air ratio.

The low fire shutter is a small, fixed, single vane shutter placed in the air box above the second, narrower vane of the main shutter to regulate air flow at low fire. At low fire, the vane of the low fire shutter is adjacent the second, narrower vane of the main air shutter, thus defining a channel through which air must flow as it moves into the impeller. Therefore, the volume of air passing into the impeller at low fire can be controlled by manipulating the low fire shutter and thereby adjusting the width of the channel formed between the low fire shutter and main air shutter. When the combustion system is at high fire, the main air shutter is fully open and the effect of the low fire shutter on air flow is minimal.

The high fire shutter is a dual vane, fixed shutter which is axially aligned with the main shutter and placed in the air box below the main shutter to regulate air flow at high fire. The high fire shutter comprises two vanes which rotate about a longitudinal axis. The high fire shutter is also positioned in the air box so that air entering the box must pass by the high fire shutter before entering the combustion system. The available range of rotation for the high fire shutter is similar to that of the main fire shutter. Therefore, the position of the high fire shutter can be fixed so that the vanes of the shutter are substantially parallel to the direction of air flow or so that the vanes of the shutter are substantially perpendicular to the direction of air flow. The vanes of the high fire shutter, however, are narrower than the vanes of the main air shutter, such that when the high fire shutter is fixed in a position which presents the maximum resistance to air flow, the air flow can still pass around the edge of either vane. As explained above, at high fire, the main air shutter is fully open. Therefore the position of the fixed high fire shutter becomes the only means for regulating high fire air flow. When the combustion system is operating at low fire, the effect of the high fire shutter on low fire air flow is minimal because the vanes of the high fire shutter are narrow enough to allow low fire volumes of air to pass into the air box uninhibited.

Finally, when the combustion system is operating in the range between low fire and high fire, the main air shutter is used to regulate the volume of air flowing into the combustion system. In this firing range, the effects of the low and high fire shutters on air flow are minimal, while the position of the main air shutter tends to have the greatest effect on air flow through the air box.

The throttle system of the present invention allows characterization of industrial burners without the complex systems described in the prior art. Further, once a fuel to air ratio is determined and the high fire and low fire shutters are adjusted to achieve this ratio, far less manpower than is required by the prior art is needed to achieve substantially the same results.

BRIEF DESCRIPTION OF THE DRAWINGS

In the drawings, which illustrate a preferred form of power-gas burners embodying the invention.

DESCRIPTION OF THE PREFERRED EMBODIMENT

In the Figures, like numerals are employed to designate like parts through the drawings, and various pieces of equipment, such as valves, fittings, pumps, and the like, are omitted so as to simplify the description of the invention. However, those skilled in the art will realize that such conventional equipment can be employed as desired.

Figure 1:
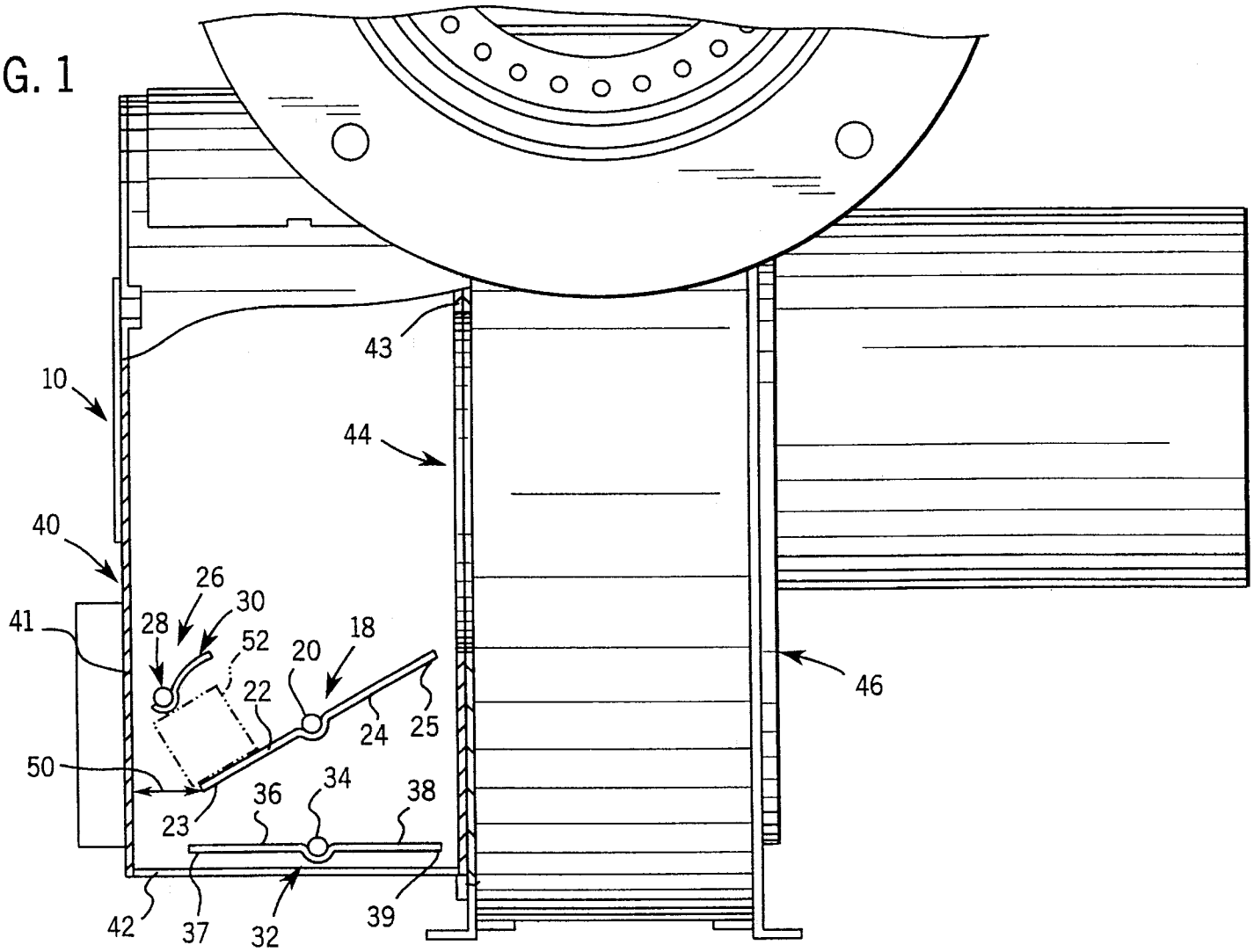
FIG. 1 is a sectional, end view of an air box of a burner embodying the invention.
Figure 2A:
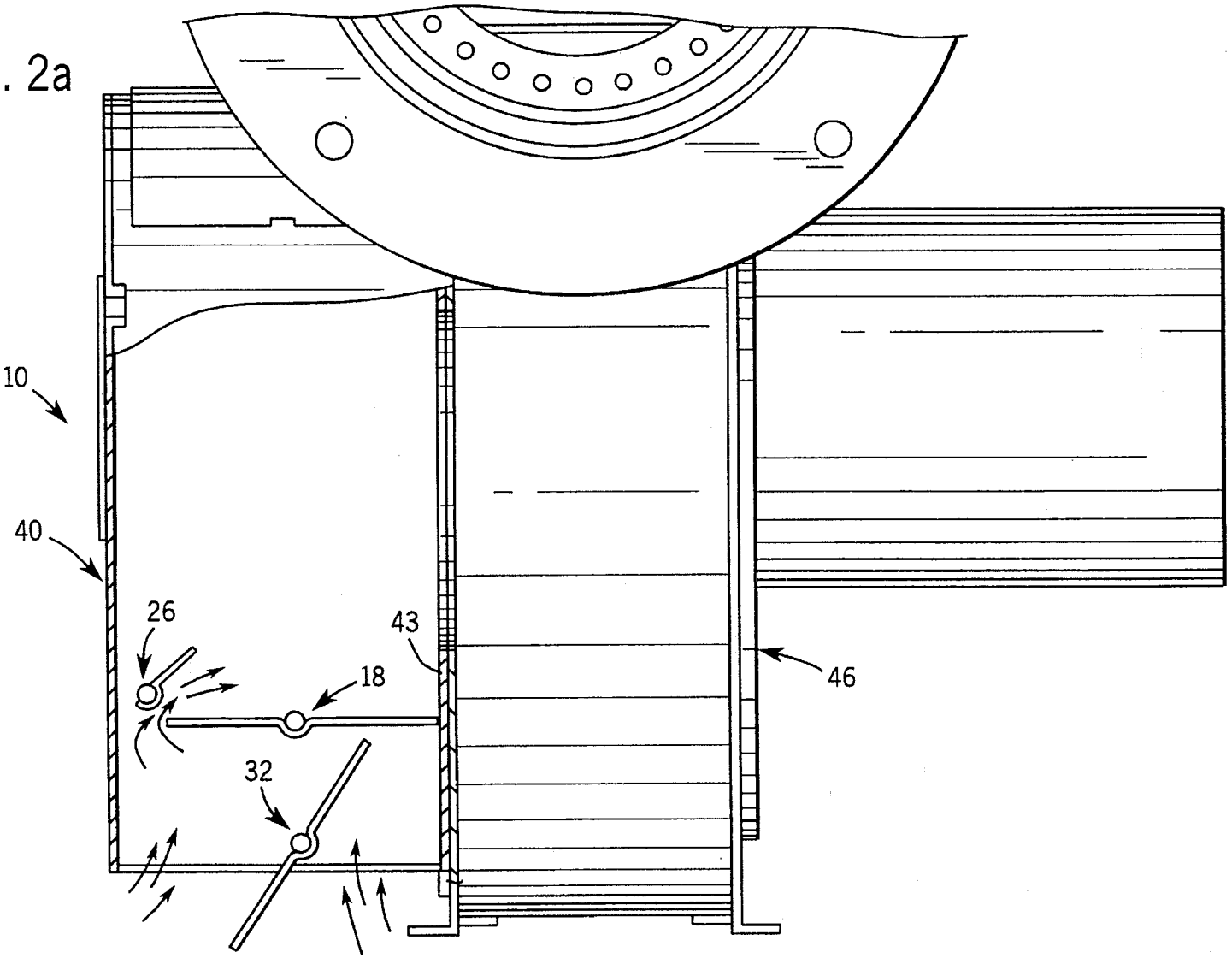
FIG. 2*a* is a sectional, end view of an air box of a burner embodying the invention when the burner is operating at low fire.
Figure 2B:
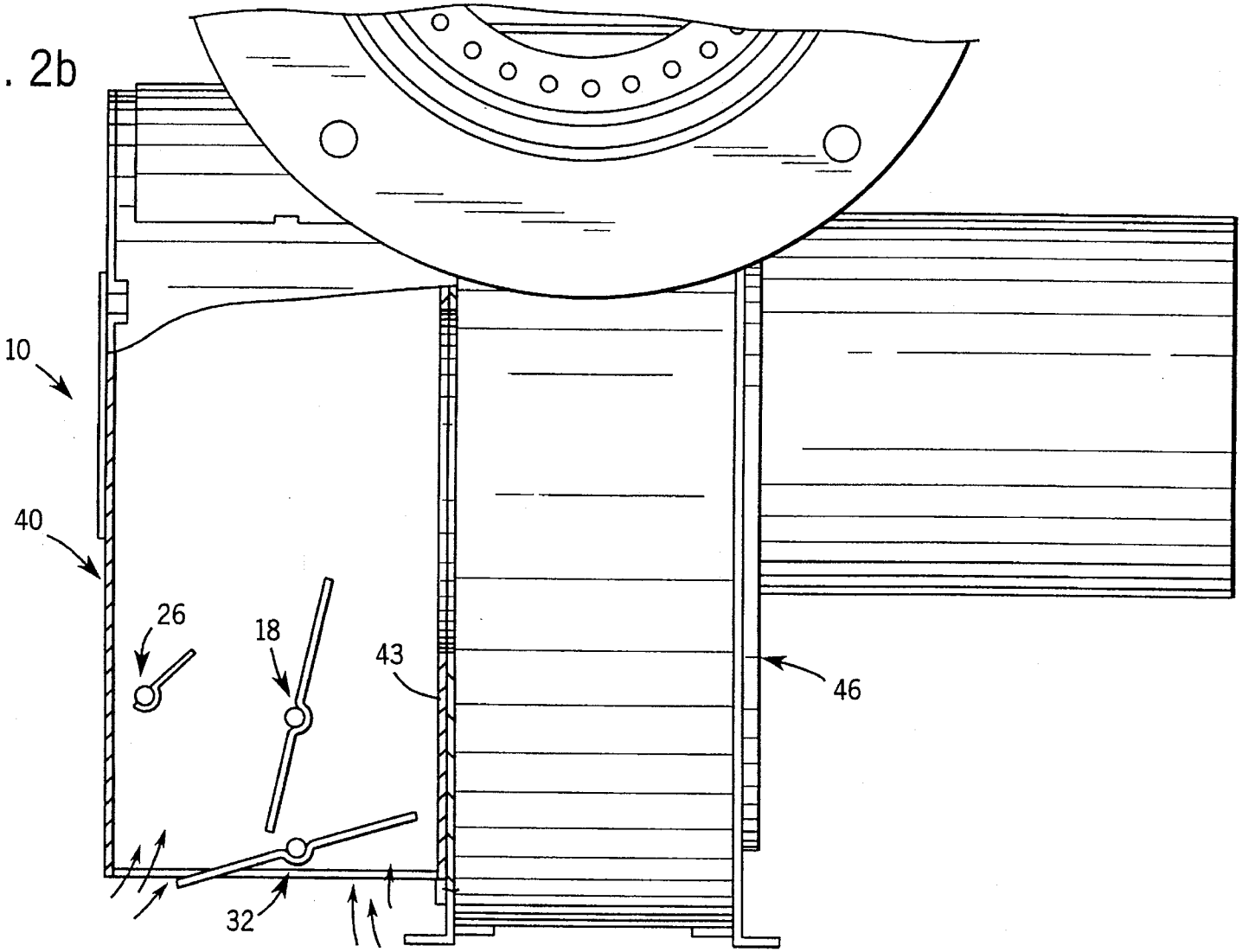
FIG. 2*b* is a sectional, end view of an air box of a burner embodying the invention when the burner is operating at high fire.

A preferred shutter assembly for characterizing combustion systems such as industrial burners is illustrated in FIGS. 1 through 2*b* and generally represented as 10. The present shutter assembly 10 comprises a main air shutter 18, a low fire shutter 26, and a high fire shutter 32, arranged in an air intake box 40 which is in fluid communication with a standard fan assembly 46 used to drive air through the combustion system. Air intake box 40 is defined in part by a first side 41 and a second side 43 adjacent said first side 41. Air box 40 contains air inlet 42, and air outlet 44. Typically, air outlet 44 is in fluid communication with an impeller (not show) which draws air through the air intake box 40 and moves air through the combustion system.

The main shutter 18 has a pair of vanes 22, 24 mounted on a shaft 20 which is rotatably mounted in air intake box 40 so that vanes 22, 24 partially span the width air intake box 40. Vane 24 is wider than vane 22. The main shutter 18 is centrally located in intake box 40 and positioned so that air entering the box 40 must pass by the main shutter 18 before entering the combustion system through air outlet 44. At high fire, main air shutter 18 is rotated to a fully open position as shown in FIG. 2*b*, such that vanes 22, 24 are substantially parallel to the direction of air flow and thus present minimal resistance as air flows toward air outlet 44. At low fire, main air shutter 18 is rotated to a fully closed position as shown in FIG. 2*a*, such that vanes 22, 24 are substantially perpendicular to the direction of air flow as it passes into air box 40. When main air shutter 18 is in a fully closed position, the outer edge 25 of vane 24 is adjacent second side 43 and the outer edge 23 of vane 22 is adjacent first side 41. Vane 24 is located so that the clearance between the vane 24 and its adjacent wall 43 allows unimpeded movement of vane 24 while allowing minimal air flow between vane 24 and wall 43. In one embodiment, vane 24 is in sealing contact with adjacent wall 43. However, vane 22 and its adjacent wall 41 define gap 50 through which air can freely flow.

Low fire shutter 26 has a single vane 30 mounted on and radially extending from shaft 28. Low fire shutter 26 is rotatably mounted above main air shutter 18 such that low fire shutter 26 is adjacent narrow vane 22. When main air shutter 18 is fully closed, an adjustable channel 52 is defined by vane 22 of the main air shutter and vane 30 of the low fire shutter. The width of the channel 52 can be adjusted by rotating vane 30. If vane 30 is rotated closer to vane 22, channel 52 becomes narrower. Conversely, if vane 30 is rotated away from vane 22, channel 52 becomes wider. During operation, low fire shutter 26 is fixed to prevent rotation. Any conventional method can be used to fix low fire shutter 26.

High fire shutter 32 has a pair of symmetrical vanes 36, 38 mounted on and radially extending from shaft 34. Shaft 34 is rotatably mounted in air intake box 40 so that vanes 36, 38 span air intake box 40. Shaft 34 is preferably centrally located in air box 40 between main air shutter 18 and air inlet 42, adequately spaced from main air shutter 18 so that there is no interference in the rotation paths of the vanes of the shutters. The width of vanes 36, 38 are substantially the same as the width of narrow vane 22 of the main shutter. High fire shutter 32 is positioned so that air entering air box 40 must pass by the high fire shutter 32 before entering the combustion system. Furthermore, the available range of rotation for the high fire shutter 32 is similar to that of the main air shutter 18. During operation, high fire shutter 32 is fixed to prevent rotation. Any conventional method can be used to fix high fire shutter 32.

When the combustion system is operating at low fire, low fire shutter 26 is fixed and main air shutter 18 is substantially perpendicular to air flowing into air box 40. A typical orientation of shutters 18, 26, 32 at low fire is illustrated in FIG. 2*a*. Because fluid flow follows the path of least resistance, air passing through air box 40 at low fire will travel through gap 50 and along channel 52 as shown in FIG. 1. The width of channel 52 can be adjusted by rotating vane 30. If vane 30 is rotated closer to vane 22, a narrower channel is formed between the two vanes and consequently less air passes into the impeller of fan assembly 46. Conversely, if vane 30 is rotated away from vane 22, a wider channel is formed and a greater quantity of air can pass into the impeller (not shown). The position of vane 30 is selected based on the quantity of air needed to maintain the desired fuel to air ratio at low fire. Once this quantity is determined, the low fire shutter is adjusted and fixed in position. This arrangement allows even the small quantities of air required at low fire to be further regulated. Therefore, a constant fuel to air ratio during low firing rates can be maintained. When the combustion system is operating at high fire, main air shutter 18 is fully open and the effect of low fire shutter 26 on air flow is minimal.

High fire shutter 32 is the principal regulator of large volumes of air entering the combustion system when operating at high fire. A typical orientation of shutters 18, 26, 32 at high fire is illustrated in FIG. 2*b*. As explained above, when the combustion system is operating at high fire, main air shutter 18 is fully open and low fire shutter 26 has little effect on the flow of air through air box 40. To provide regulation of high fire volumes of air entering the combustion system, high fire shutter 32 is employed. The function of high fire shutter 32 is very similar to a standard servo-motor controlled butter-fly type throttle, except that high fire shutter 32 is adjusted and fixed in one position because it is only needed to regulate air volume at or near the high fire rate. During initial set-up, the amount of air required to maintain the fuel to air ratio of the combustion system operating at high fire is determined. High fire shutter 32 is adjusted to allow this amount of air to enter air box 40 when main air shutter 18 is fully open. When the combustion system is operating at low fire, the effect of high fire shutter 32 on low fire air flow rates is minimal because vanes 36, 38 of the high fire shutter are narrow enough to allow low fire volumes of air to pass into the air box uninhibited.

When the combustion system is operating in the range between low fire and high fire, main air shutter 18 is used to regulate the volume of air flowing into the combustion system. In this firing range, the effects of low fire shutter 26 and high fire shutter 32 on air flow are transitional, while the position of the main air shutter tends to have the greatest effect on air flow through the air box. Therefore, main air shutter 18 functions as standard servo-motor controlled butter-fly type throttle. Unlike low fire shutter 26 and high fire shutter 32, main air shutter 18 is not fixed because it is used to regulate air flow through the entire range between high and low fire. In the preferred embodiment, a servo-motor (not shown) is used to control the position of main air shutter 18.

Figure 3:
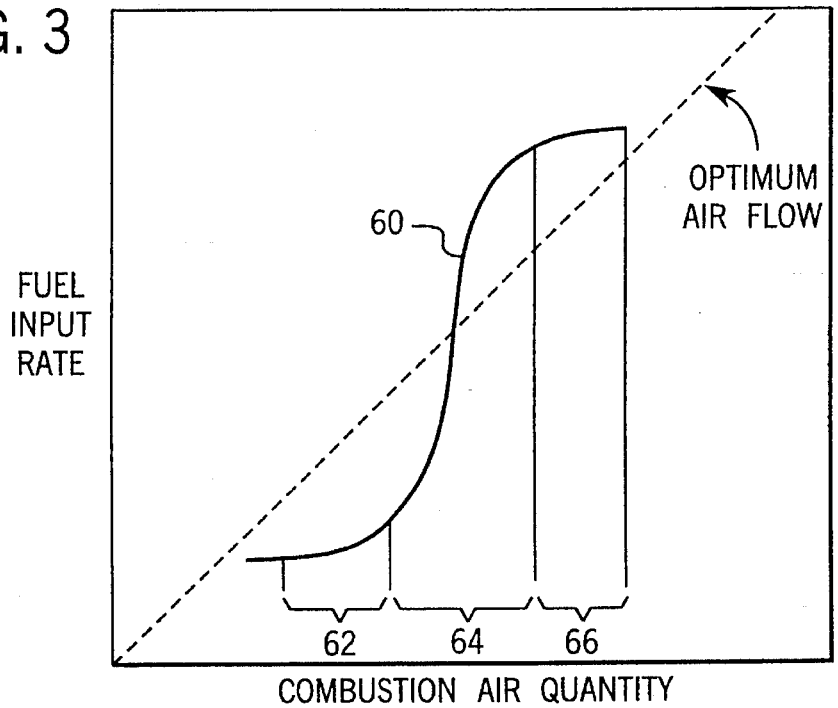
FIG. 3 is a graphical representation of a standard fuel or air combustion curve where the firing rate is a function of quantity.

Turning now to FIG. 3, a typical S-shaped combustion air curve 60 is shown depicting the relationship between firing rate and combustion air flow for a butterfly type throttle plate. Curve 60 can represent either a fuel or an air combustion curve, in that the volume for either fuel or air must increases with increased firing rates. Segment 62 represents the low fire portion of combustion curve 60. Segment 64 represents the mid-range firing rates of curve 60, while segment 66 represents the high fire portion of the combustion curve. Standard single shutter throttles such as main air shutter 18 are most effective in adjusting the volume of air entering the burner when the firing range falls within that represented by segment 64. The graphical effect of adjustments to single shutter throttles, relative to fuel input, is to shift the S-shaped combustion curve to the right or left.

However, this type of throttle cannot be used to shift the curve up or down.

Figure 4:
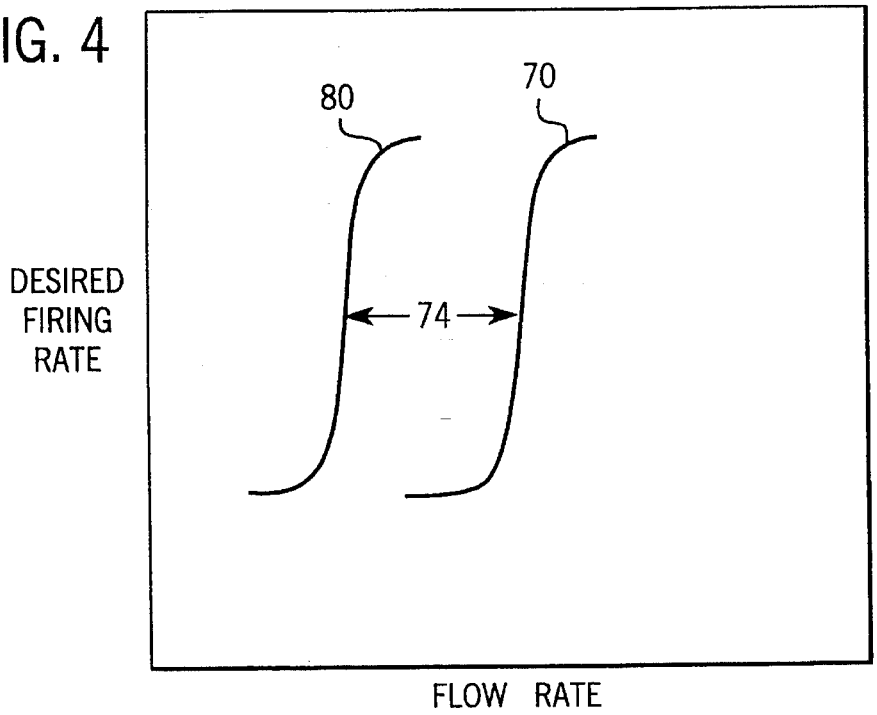
FIG. 4 is a graphical representation of a standard air combustion curve overlaid with a standard fuel combustion curve where firing rate is a function of quantity.

FIG. 4 shows a combustion curve for air 70 together with a typical combustion curve for fuel 80, representing the quantity of fuel and air in a fuel-air mixture used in combustion systems. The combustion curve for fuel 80 is shown as an S-shaped curve because the introduction of fuel is also controlled by non-linear devices such as a butterfly valve. Ideally fuel and air mixtures comprise equivalent proportions of fuel and air at each firing rate, such that air combustion curve 70 would match fuel combustion curve 80 in shape. This equivalent matching would result in a single curve if the individual combustion curves for fuel and air were overlaid. It is typically the practice to maintain about ten percent more air than fuel in the fuel-air mixture to insure that the fuel is completely consumed during combustion. This ten percent quantity difference results in air combustion curve 60 leading fuel combustion curve 70, as is seen in FIG. 4. Fuel that is not burned during firing can result in carbonization and decreased efficiency. As was explained above, it is also desirable to maintain a constant air to fuel ratio as the combustion system is fired between high fire and low fire. In practice, the amount of fuel required for a particular firing rate is determined and then the air volume is adjusted accordingly to match the shape of the predetermined fuel curve. As mentioned above, a single shutter throttle valve, such as main air shutter 18, is effective for regulating the flow of air needed to maintain a constant fuel to air ratio during firing in the range represented by segment 64, and graphically allowing its air combustion curve to be shifted left or right. However, this type of throttle loses its effectiveness in the firing ranges represented by segments 62, 66, and it is difficult to match the high fire and low fire portions of the air combustion curves to those of the fuel curve. High fire shutter 32 allows the high fire portion of air curve 70, generally represented by segment 66 of FIG. 3, to be shifted up or down to match more closely the shape of the fuel curve at high fire. Conversely, low fire shutter 26 allows the low fire portion of air curve 70, generally represented by segment 62 of FIG. 3, to be shifted up or down to match more closely the shape of the fuel curve at low fire. In other words, low fire shutter 26 and high fire shutter 32 can be manipulated to shift the low and high fire portions of the air combustion curve up and down, allowing the air combustion curve to be more closely matched with the fuel combustion curve. Because low fire shutter 26 and high fire shutter 32 are only effective at regulating air flow for these limited ranges, and because the shutters do not have any significant effect on air flow outside of their particular range, these shutters can be fixed and need not be adjusted during operation of the combustion system.

Shutter assembly 10, therefore, allows the fuel to air ratio of the combustion system to remain relatively constant as the system is driven through a combustion range from a high fire rate to a low fire rate. The combination of low fire shutter 26 and main air shutter 18 regulates low fire volumes of air entering the combustion system when it is operating at low fire. The high fire shutter 32 regulates high fire volumes of air entering the combustion system when it is operating at high fire. Main air shutter 18 regulates air volumes required by the combustion system for the range of firing rates between low fire and high fire.

Although the invention is not intended to be limited by specific dimensions for the elements recited herein, applicant has found that the dimensional relationships described below are preferred, wherein the vane widths for each of the shutters is a percentage of the overall width of air box 40. The overall width of air box 40 is the perpendicular linear distance between first side 41 and second side 43. The width of vane 30 of low fire shutter 26 generally ranges from approximately 0.05 to 0.03 of the width of air box 40 and preferably is approximately 0.18 of the width of air box 40. The widths of vanes 36, 38 of high fire shutter 32, as well as the width of narrow vane 22 of main air shutter 18, generally range from approximately 0.25 to 0.45 of the width of air box 40 and preferably are approximately 0.36 of the width of air box 40. The width of vane 24 of main air shutter 18 generally ranges from approximately 0.35 to 0.55 of the width of air box 40 and preferably is approximately 0.44 of the width of air box 40. To provide unimpeded movement of vane 24 while allowing minimal air flow between vane 24 and wall 43, shaft 20 of main air shutter 18 is located a perpendicular linear distance from second side 43 of approximately 0.125 inches (3.175 mm) plus the width of vane 24. The perpendicular linear distance between shaft 28 of low fire shutter 26 and shaft 20 of main air shutter 18 is approximately 0.375 to 0.500 inches (9.525 to 12.700 mm).

In another preferred embodiment, vane 30 of low fire shutter 26 may be curved outward away from vane 22 of main air shutter 18. This will increase the volume of air flowing through channel 52.

One of the advantages of the invention described herein is its use with combustion systems containing flue gas recirculation (FGR) means. Those skilled in the art will understand that flue gas recirculated into air intake boxes, i.e., throttle chambers, creates an additional variable which must be accounted for when adjusting the multiple linkages described in the single shutter systems of the prior art. The present invention may be adjusted for FGR using the same techniques as for non-FGR systems. The system functions the same with or without FGR.

Although the invention has been described in considerable detail through the figures and above discussion, many variations and modifications can be made by one skilled in the art without departing from the spirit and scope of the invention as described in the following claims.

What is claimed:

1. A throttle characterization assembly for use in a standard air box having an air inlet and an air outlet, comprising:

a. a main air shutter rotatably mounted in the air box between the air inlet and the air outlet, said main air shutter having a first vane and a second vane radially extending from a shaft;

b. a high fire shutter rotatably mounted in the air box between said main air shutter and the air inlet, said high fire shutter having a first high fire vane and a second high fire vane radially extending from a high fire shaft; and c. a low fire shutter, rotatably mounted in the air box between said main air shutter and the air outlet, said low fire shutter having a single low fire vane radially extending from a shaft, wherein said low fire shutter is located adjacent the second vane of said main air shutter.

2. The throttle characterization assembly of claim 1, wherein said second vane of said main air shutter is narrower than said first vane.

3. The throttle characterization assembly of claim 1 wherein said single low fire vane is curved.

4. The throttle characterization assembly of claim 1 wherein said first and second high fire vanes are narrower than said first vane of said main air shutter.

5. A throttle characterization assembly for use in a standard air box having an air inlet, an air outlet, a first wall and a second wall, comprising:

a. a main air shutter, rotatably mounted in the air box between the air inlet and the air outlet, said main air shutter having a first vane and a second vane radially extending from a shaft, wherein said second vane is narrower than said first vane and can be rotated to a position adjacent the first wall of the air box such that the first wall and the second vane define a gap therebetween;

b. a high fire shutter, rotatably mounted in the air box between said main air shutter and the air inlet, said high fire shutter having a first high fire vane and a second high fire vane radially extending from a high fire shaft, wherein said high fire vanes are narrower than said first vane of said main air shutter; and c. a low fire shutter, rotatably mounted in the air box between said main air shutter and the air outlet, said low fire shutter having a single, curved low fire vane radially extending from a shaft, wherein said low fire shutter is located adjacent the second vane of said main air shutter and above the gap defined by said first wall and said second vane such that the adjacent vanes define a passage therebetween.

6. The throttle characterization assembly of claim 5 wherein said first vane of said main air shutter can be rotated to a position adjacent the second wall of the air box such that said first vane is in sealing contact with the second wall.

7. A throttle characterization assembly for use in a standard air box having an air inlet, an air outlet, a first wall and a second wall having an air box width therebetween, comprising:

a. a main air shutter, rotatably mounted in the air box between the air inlet and the air outlet, said main air shutter having a first vane whose width is between 0.35 and 0.55 the air box width and a second vane whose width is between 0.25 and 0.45 the air box width, wherein said first and second vanes are radially extending from a shaft;

b. a high fire shutter, rotatably mounted in the air box between said main air shutter and the air inlet, said high fire shutter having a first high fire vane and a second high fire vane radially extending from a high fire shaft, wherein the width of said first high fire vane is between 0.25 and 0.45 the air box width and the width of said second high fire vane is between 0.25 and 0.45 the air box width; and c. a low fire shutter, rotatably mounted in the air box between said main air shutter and the air outlet such that said low fire shutter is adjacent the second vane of said main air shutter, said low fire shutter having a single low fire vane whose width is between 0.05 and 0.30 the air box width, wherein said low fire vane is radially extending from a low fire shaft.

8. An industrial burner having an air throttle comprising:

a. a throttle chamber having an air inlet and an air outlet;

b. a main air shutter, rotatably mounted in said chamber between said air inlet and said air outlet, said main air shutter having a first vane and a second vane radially extending from a shaft;

c. a high fire shutter, rotatably mounted in said throttle chamber between said main air shutter and said air inlet, said high fire shutter having a first high fire vane and a second high fire vane radially extending from a high fire shaft; and d. a low fire shutter, rotatably mounted in said throttle chamber between said main air shutter and said air outlet, said low fire shutter having a single low fire vane radially extending from a shaft, wherein said low fire shutter is located adjacent the second vane of said main air shutter.

9. A throttle characterization assembly for use in a standard air box having an air inlet and an air outlet, comprising:

a. a main air shutter rotatably mounted in the air box between the air inlet and the air outlet, said main air shutter having at least one main air vane radially extending from a shaft;

b. a high fire shutter rotatably mounted in the air box between said main air shutter and the air inlet, said high fire shutter having at least one high fire vane radially extending from a high fire shaft; and c. a low fire shutter, rotatably mounted in the air box between said main air shutter and the air outlet, said low fire shutter having a single low fire vane radially extending from a shaft.

* * * * *